US009752843B2

(12) United States Patent
Garver et al.

(10) Patent No.: US 9,752,843 B2
(45) Date of Patent: Sep. 5, 2017

(54) BOW WITH ADJUSTABLE HANDLE

(71) Applicants: Patrick Garver, Washingon, IL (US); Paul Reynolds, Virginia, IL (US)

(72) Inventors: Patrick Garver, Washingon, IL (US); Paul Reynolds, Virginia, IL (US)

( * ) Notice: Subject to any disclaimer, the term of this patent is extended or adjusted under 35 U.S.C. 154(b) by 106 days.

(21) Appl. No.: 13/919,363

(22) Filed: Jun. 17, 2013

(65) Prior Publication Data

US 2014/0366858 A1 Dec. 18, 2014

(51) Int. Cl.
*F41B 7/00* (2006.01)
*F41B 5/14* (2006.01)
*F41B 5/10* (2006.01)

(52) U.S. Cl.
CPC ..... *F41B 5/1403* (2013.01); *F41B 5/10* (2013.01); *Y10T 29/49826* (2015.01)

(58) Field of Classification Search
CPC ..... F41B 5/00; F41B 5/10; F41B 5/14; F41B 5/22
USPC .... 124/23.1, 25.6, 35.2, 44.5, 48, 86, 88, 89
See application file for complete search history.

(56) References Cited

U.S. PATENT DOCUMENTS 3,491,739 A * 1/1970 Scrobell ..... F41B 5/0031 124/23.1
3,537,440 A 11/1970 Izuta et al.
5,119,796 A 6/1992 Dehlbom
5,243,958 A 9/1993 Shepleym, Jr.
5,349,937 A 9/1994 Burling
5,469,834 A 11/1995 Higgins et al.
6,763,820 B1 * 7/2004 Pinto, Jr. ..... F41B 5/143 124/25.6
7,066,165 B2 6/2006 Perry
7,708,004 B2 5/2010 Moss et al.
7,958,881 B2 * 6/2011 Silverson ..... F41B 5/14 124/86
8,079,353 B2 12/2011 Davis et al.
8,360,044 B2 1/2013 Platt
2005/0229912 A1 * 10/2005 Pilpel ..... F41B 5/10 124/86
2007/0193571 A1 8/2007 Moss
2011/0011385 A1 * 1/2011 Grace, Jr. ..... F41B 5/10 124/25.6
2012/0210991 A1 * 8/2012 Yehle ..... F41B 5/0094 124/25.6
2013/0244842 A1 * 9/2013 Henley ..... A63B 21/0726 482/106

(Continued)

*Primary Examiner* — Aarti B Berdichevsky
*Assistant Examiner* — Christopher Glenn
(74) *Attorney, Agent, or Firm* — Trojan Law Offices

(57) ABSTRACT

A versatile hunting bow with a circular rotatable handle mounted on a circular frame of the riser of the bow. The riser is skeletonized and has an asymmetrical shape. The archers can rotate and adjust the orientation of the handle to their natural wrist position. The outer wall of the circular handle has a series of parallel thread cuts that match with the thread cuts on the inner wall of the circular frame of the riser. Two limbs are connected and secured to the riser through limb bolts. When limb bolts are tightened, the geometry of the riser and the arrangement of the limbs create tensions that slightly distort the shape of the riser. The distortion prevents the thread cuts from moving along each other. Thus, the handle is no longer able to rotate when the limb bolts are tightened and the handle is locked.

10 Claims, 7 Drawing Sheets

(56) References Cited

U.S. PATENT DOCUMENTS

2013/0340735 A1* 12/2013 Emory ..... F41B 5/1403
124/23.1

* cited by examiner

BOW WITH ADJUSTABLE HANDLE

FIELD OF THE INVENTION

This invention relates to archery bows and compound bows. In particular, this invention relates to a versatile compound bows with adjustable and rotatable handle that allows archers to hold the bows with their most comfortable and natural wrist position.

BACKGROUND

Accuracy in archery is often materially affected by the stance of the archer, the way the archer grips the bow, and the unbalanced force generated in releasing the string. Several problems are commonly associated with archery. These problems include bow torqueing, fatigue of the archer, insufficient strength and insufficient forearm clearance.

Bow torqueing is a common problem associated with an archer's poor hand position when gripping the handle of the bow. Hand torque occurs when the archer exerts pressure on the bow's riser at the handle and unintentionally twists the bow when the archer releases the string. This twist turns the proper position and creates mis-alignment of the allow axis to the handle, which subsequently causes the arrow to travel in an unintended direction. This could also result in the arrow fishtailing. The accuracy of the archer is significantly affected by the hand torque and mis-alignment. The torqueing problem is usually remedied by training the archer to adopt proper hand position. However, in situations such as bow hunting, archers sometimes find themselves shooting from unusual or inconvenient locations, thus preventing the archer from gripping the bow in a proper position.

The alignment and the position of the bow when the archer aims are also important to achieving accuracy. The bow should be vertical when the archer aims and shoots. To align the bow vertically, archers are often required to turn their wrist and elbow away from their most natural and comfortable position. This could easily tire many archers, causing poor form and accuracy.

Forearm clearance refers to the space between the archer's forearm of the arm holding the bow and the arrow. Insufficient forearm clearance can result in a part of the arrow, such as the fletch, contacting the forearm or the clothing of the archer when the arrow is released. This can alter the normal travel path of the arrow, causing the arrow to miss the target. Normally, the archer's bow arm, his line of sight, and the sight aim should form a straight line and be aligned with the arrow's line of travel. Such proper form inevitably reduces forearm clearance because the bow arm has to be straightened and be positioned adjacent to the arrow. For most of the common stances in archery, the archers often find themselves in a dilemma in maintaining the proper stance while maximizing forearm clearance.

SUMMARY

In view of the foregoing, the present invention is directed to a versatile hunting bow with a special riser that comprises a circular rotatable handle which allows the archers to adjust the handle orientation to their most natural wrist position. The present invention is also directed to a hunting bow with a circular rotatable handle, which can be locked through tightening the limb bolts that connect the limbs and the riser of the bow.

In some embodiments of the present invention, the versatile bow comprises a riser, an upper limb and a lower limb secured to the riser through limb bolts, a string or a set of strings connected to the far ends of the upper limb and the lower limb, a sight and an arrow rest mounted on the riser and located at the approximate center of the bow, and two stabilizers. The riser is made of skeletonized metal alloys such as magnesium alloy. The riser comprises mainly four regions—a circular frame that is ring shaped, a lower arm connected to the lower side of the outer circumference of the circular frame, an upper arm connected to the upper side of the outer circumference of the circular frame, and a circular rotatable handle mounted on the circular frame. The handle can rotate circularly along the inner circumference of the circular frame.

In some embodiments of the present invention, the riser has an asymmetrical shape. The circular frame is located in the lower part of the riser. The upper arm is connected to the circular frame at a position slightly right of the middle of the riser. The location of the circular frame and the upper arm allows the arrow rest to be placed right at the center of the entire bow so that the arrow's line of travel can be aligned more accurately to the orientation of bow. A turn exists in the middle of the upper arm so that the limb pockets at the upper arm and the lower arm can align with each other.

In some embodiments of the present invention, the inner wall of the circular frame contains a series of parallel thread cuts. Moreover, the circular handle comprises a handgrip along its diameter and a circular wall along its circumference. On the outer circumference wall of the handle, it also contains a series of parallel thread cuts. The depth and dimension of the thread cuts should match with those of the thread cuts on the inner wall of the circular frame. Thus, when the handle is put in the circular frame, the handle is mounted on the riser through matching the thread cuts. Since both thread cuts are parallel, the handle can freely rotate planarly along the inner circumference of the circular frame without the chance of coming off from the riser.

In some preferred embodiments of the present invention, the bow comprises a locking mechanism that allows archers to lock the handle without installing or using any additional structural component. The riser has a special geometry in which the upper arm and the lower arm elevate away from the position of the circular frame so that the circular frame is located at a position closer to the string. When the limb bolts that secure the limbs to the riser are tightened, the string of the bow creates a tension that pulls the upper limb and the lower limb toward each other. As a consequence, the limbs create a force that pulls the elevated upper arm and lower arm of the riser slightly toward the position of the circular frame. This slightly distorts the shape of the riser, especially the shape of the circular frame. Since the thread cuts on the inner wall of the circular frame and those on the outer wall of the handle match with each other, they are sensitive to slight change in shape. As a result of the distortion, the parallel thread cuts can no longer move along each other smoothly. Thus, the distortion in the shape of the riser prevent the handle from further rotating. This locks the orientation of the handle. However, when the limb bolts are loosened, the string and the limbs no longer create any tension. The riser returns to its natural shape. Now the thread cuts can move along each other. This allows the archers to turn the handle when the limbs of the bow are not tightened.

DETAILED DESCRIPTION OF EMBODIMENTS

The following description is made for the purpose of illustrating the general principles of the invention and should not be taken in a limiting sense. The scope of the invention is best determined by reference to the appended claims.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Exemplary embodiments of the present invention are described herein with reference to idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing.

Figure 1A:
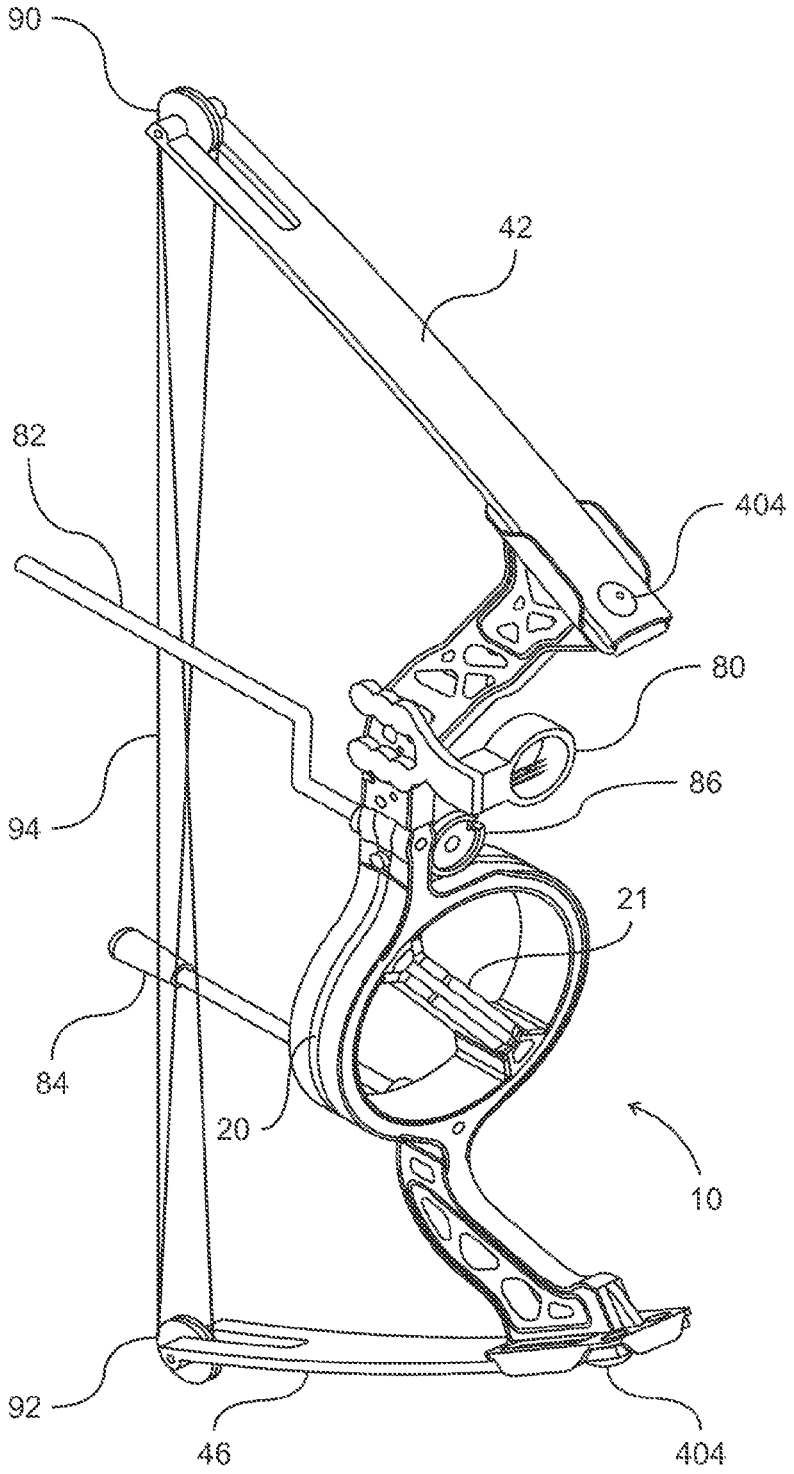
FIG. 1A is a perspective view of a bow in accordance with an embodiment of the present invention.

FIG. 1A is a perspective view of a versatile bow 10 in accordance with an embodiment of the present invention. The versatile bow 10 comprises a riser 20, an upper limb 42, an lower limb 46, two cams or pulleys 90 and 92, a system of strings 94, two stabilizers 82 and 84, an arrow rest 86, and a sight 80. The upper limb 42 and the lower limb 46 are connected and secured to opposing ends of the riser 20 by the limb bolts 404. The versatile bow 10 can be dismantled by unscrewing the limb bolts 404 and detaching the upper limb 42 and the lower limb 46 from the riser 20. An upper cam 90, preferably a compound cam, rotatably engages with one end of the upper limb 42. A lower cam 92 also rotatably engages with the lower limb 46 in the same or similar way of the upper limb 46. A system of strings 94, extending between and connecting at the ends of the upper limb 42 and the lower limb 46, tangentially touches the track in the cams 90 and 92. The riser 20, the limbs 42 and 46, the cams 90 and 92, and the system of strings 94 are the key working components of the versatile bow 10.

Different accessories can be added to the versatile bow 10 to increase its functionality and accuracy. As shown in FIG. 1A, an upper stabilizer 82 and a lower stabilizer 84 are inserted to the riser 20. The stabilizers 82 and 84 are installed to dampen vibration and steady archer's bow arm when the archer is aiming. They also reduce torqueing when the archer releases the strings 94. An arrow rest 86 with a rest bracket is mounted to the riser 20 at a position right above the circular frame of the riser 20. Preferably the arrow rest 86 should be located at the center of the riser 20 so that the arrow head can be rested on the center of the versatile bow 10 and the arrow's line of travel can be aligned more accurately to the orientation of the versatile bow 10. A sight 80 is located right above the arrow rest 86 and is mounted, statically or pivotally, on the riser 20 to assist the archer's targeting. To enhance the accuracy of targeting, the sight 80 should be located adjacent to the arrow rest 86 so that the axis of the bow sight is parallel to the arrow's line of travel.

It will be appreciated that different accessories can be connected to the riser 20 through the apertures and the skeleton structure of the riser 20. The apertures 38 and 40 and the structural elements 30 and 32 are best shown in FIG. 2A and FIG. 2B. For example, stabilizers with different shapes and orientations can be inserted to various apertures on the riser 20 at different locations. Also, the archer can choose the preferred brand and model of sight 80. The versatile bow 10 can be used for shooting without any accessories mounted on the riser 20.

The upper limb 42 and the lower limb 46 are made of slightly flexible materials compared to the riser 20. The materials of the limbs 42 and 46 can be wood or plastic. The limbs 42 and 46 are relatively flexible so that when the archer pulls the strings 94, the limbs will temporarily bend inward towards each other. This provides part of the recoiling force to propel the arrow when the archer releases the strings 94. The riser 20 remains rigid to provide mechanical strength to the bow when the strings are drawn. It will be appreciated that the limbs 42 and 46 are replaceable. For example, they can be aftermarket products so long as the limbs can be connected and secured to the riser 20 through the limb bolts 404. The length of the limbs 42 and 46 can vary, depending on the preference of the archer and the desired strength of the versatile bow 10.

Figure 1B:
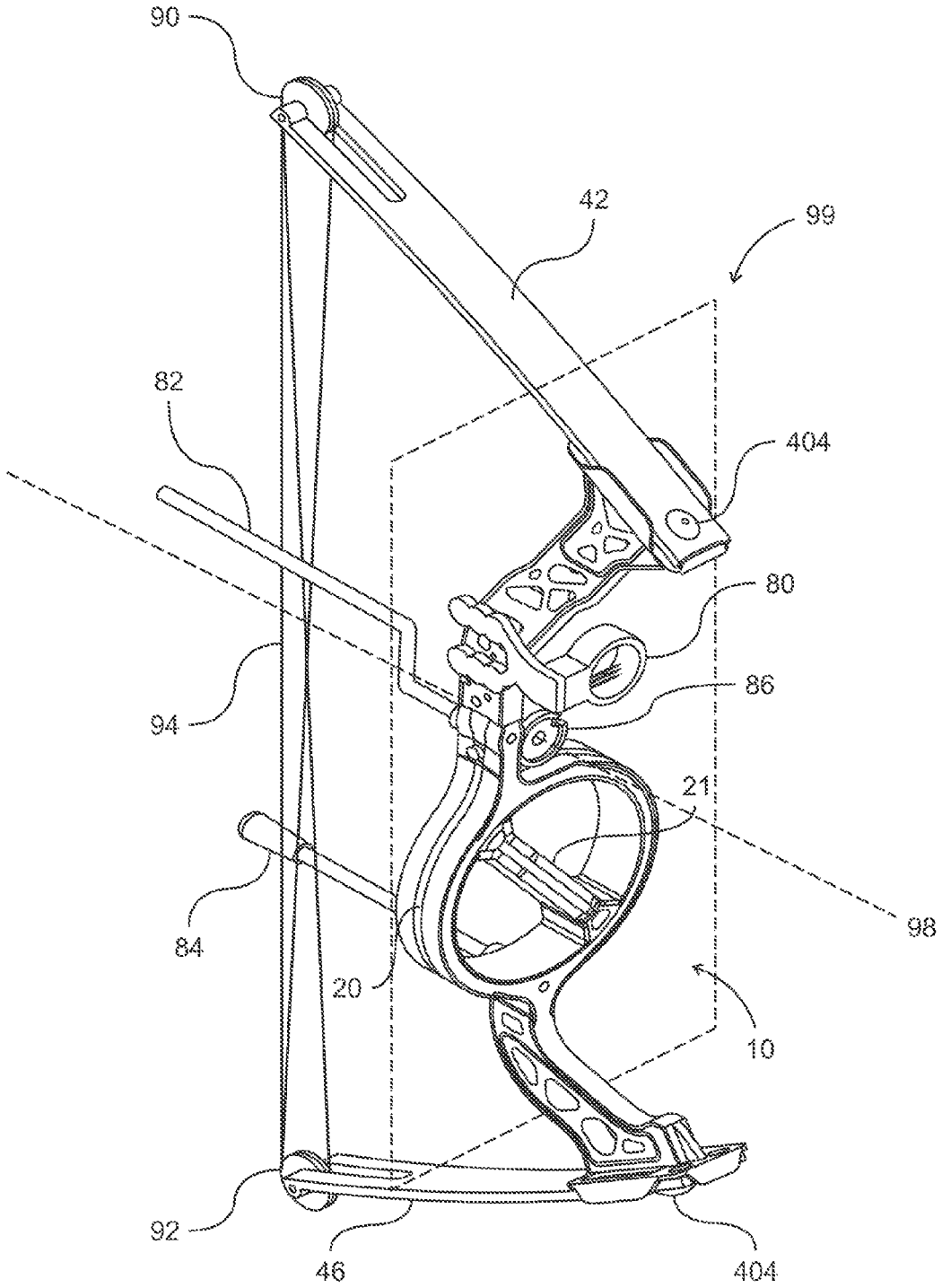
FIG. 1B is a perspective view of a bow in accordance with an embodiment of the present invention with an imaginary line and an imaginary plane.

FIG. 1B has dotted lines to define a key direction and a key surface of the bow 10. The dotted line that passes through the arrow rest 86 represents the line of travel 98 of the arrow. The dotted rectangle represents a plane 99 that is substantially perpendicular to the line of travel 98 of the arrow. The plane on which the circular frame 22 flatly sits is substantially parallel to the plane 99. The plane on which the handle 21 rotates circumferentially is also substantially parallel to the plane 99. The phrases "rotate planarly" and "rotate circumferentially" should refer to the direction of rotation of an object on any plane that is substantially parallel to the plane 99.

The riser 20 is the middle and the most rigid part and the largest component of the versatile bow 10. Preferably, it is made of materials that are strong, rigid and light. It can be fabricated from magnesium alloy, aluminum and titanium alloys, fiber-reinforced polymers, carbon composites, or glass-loaded polymers. A variety of manufacturing techniques may be employed to fabricate the riser. In the cases of metal alloys, machining or casting may be used. In the cases of carbon composites or other polymers, molding with a bladder can be used to achieve the desired shape of the riser 20.

Figures 3, 4:
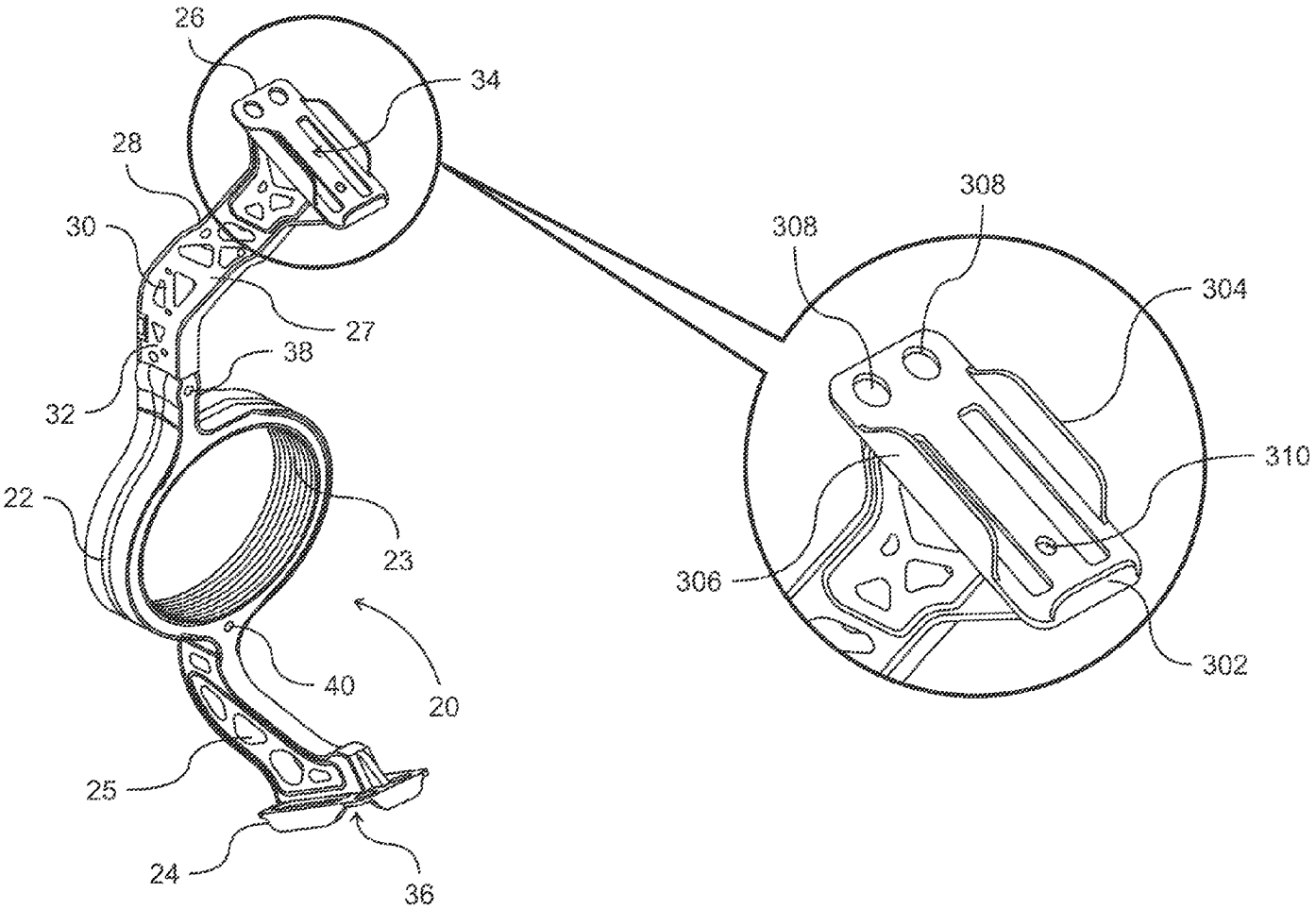
FIG. 3 is a perspective view of a riser of a bow in accordance with an embodiment of the present invention without the circular rotatable handle installed.
FIG. 4 is an enlarged prospective view of a limb pocket of the riser shown in FIG. 3 in accordance with an embodiment of the present invention.

Referring now to FIG. 2A, 2B, and 3, FIG. 2A is a front view of a riser 20 of a versatile bow 10 showing a circular rotatable handle 21 in accordance with an embodiment of the present invention. FIG. 2B is a side view of the riser 20 shown in FIG. 2A. FIG. 3 is the perspective view of the riser 20 shown in FIG. 1A. FIG. 3 shows several major regions of the riser 20, including a lower end 24, a lower arm 25, a circular frame 22, an upper arm 27 with a turn 28 that bend the upper arm 27, and an upper end 26. The lower limb pocket 36 is located at the lower end 24, and the upper limb pocket 34 is located at the upper end 26. The circular frame 22 is the part on which the circular rotating handle 21 is mounted or installed. The lower arm 25 is the riser's lower elongated region that is in between the lower limb pocket 36 and the circular frame 22. The upper arm 27 is the riser's upper elongated region that is in between the upper limb pocket 34 and the circular frame. The shape and dimension of the lower arm 25 and the upper arm 27 are best illustrated in FIG. 3. The riser 20 also contains two apertures 38 and 40. These apertures are provided for stabilizers 82 and 84 or other accessories to be installed (FIG. 1A).

The riser 20 has an asymmetrical shape. For the purpose of illustration, a dash line is added to represent the middle axis of the riser 20 in FIG. 2A. The circular frame 22 is located in the lower part of the riser 20. Under the view of FIG. 2A, the portion of upper arm 27 before the turn 28 that is connected to the circular frame 22 is located slightly right of the middle axis of the riser 20. The location of the circular frame 22 and the upper arm 27 allows the arrow rest 86 (shown in FIG. 2C) to be placed right at the center of the bow 10 so that the arrow's line of travel can be aligned more accurately to the orientation of the versatile bow 10. The space between the middle vertical axis and the upper arm 27 before the turn 28 provides location for the sight 80 and the arrow rest 86 to be placed so that the sight 80 and the arrow rest 86 can be located on the middle vertical axis for more accurate aiming and shooting, as shown in FIG. 2C.

Figure 2C:
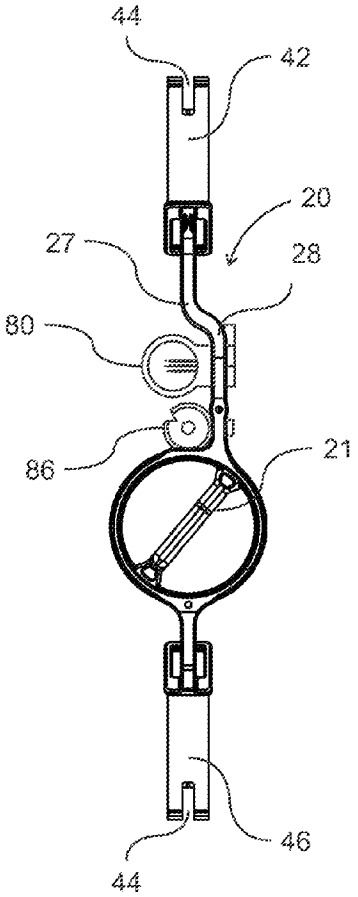
FIG. 2C is a front view of the riser of the bow shown in FIG. 2A with two limbs, a sight, and an arrow rest installed in accordance with an embodiment of the present invention.
Figure 2B:
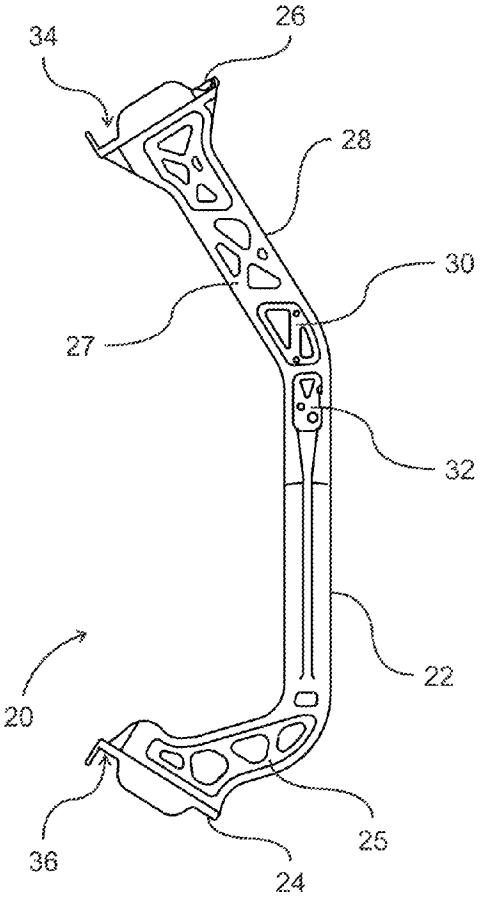
FIG. 2B is a side view of the riser of the bow shown in FIG. 2A in accordance with an embodiment of the present invention.
Figure 2A:
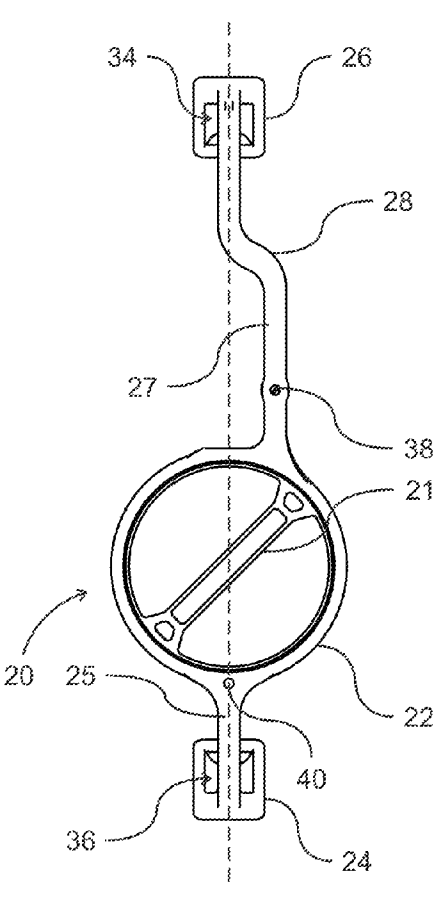
FIG. 2A is a front view of a riser of a bow showing a circular rotatable handle in accordance with an embodiment of the present invention.

Referring now both to FIG. 2A and FIG. 2C, FIG. 2C shows the front view of the riser 20 with the upper limb 42 and the lower limb 46 installed. Slots 44 are located at the upper end of the upper limb 42 and the lower end of the lower limb 46 for the cams 90 and 92 to be inserted. The upper limb pocket 34 and the lower limb pocket 36 must be aligned so that when the string 94 and the cams 90 and 92 are installed, the string 94 will be vertical and be located at the middle axis shown in FIG. 2A. Thus, the turn 28 is present to bend the upper arm 27 towards the middle vertical axis. The unique asymmetrical shape of riser 20 allows the string 94, sight 80 and arrow rest 86 all be located at the middle of bow 10. The alignment of these components allow the arrow to be shot from the center of the bow 10 and travel in a direction perpendicular to the plane shown in FIG. 1B. The archer's line of sight will also be aligned and parallel to the travel direction of the arrow. This enhances the accuracy of arrow shooting using the embodiments of the present invention.

Referring now specifically to FIGS. 2B and 3, the figures show the side view and perspective view of the riser 20. In a preferred embodiment of the present invention, the riser 20 is skeletonized to reduce the weight of the riser 20 and to provide aesthetic appearance to the riser 20. The skeletonized riser 20 can also provide structural elements 30 and 32 for bow accessories, such as sight 80 and stabilizers 82 and 86, to be mounted on the riser 20. The exact shape and dimension of the structural elements 30 and 32 would depend on the design of the bow 10 and the intended accessories to be mounted on the riser 20.

FIG. 3 shows the inner wall of the circular frame 22. The inner wall contains a series of parallel thread cuts 23. The depth and dimension of the thread cuts 23 can be based on the Unified Thread Standard. Preferably, approximately six to eight threads are cut per inch. Other density of the thread cuts 23 may also be used. When the handle 21 is installed, the handle 21 can rotate planarly on the plane of the circular frame 22, which is the surface that is substantially perpendicular to the direction of travel of the arrow 98, and be locked in a manner that will be described in a greater detail below. The rotational direction can also be described as rotating circumferentially along the inner circumference of the circular frame 22 or rotating concentrically with the center of the circular frame 22.

Figure 5B:
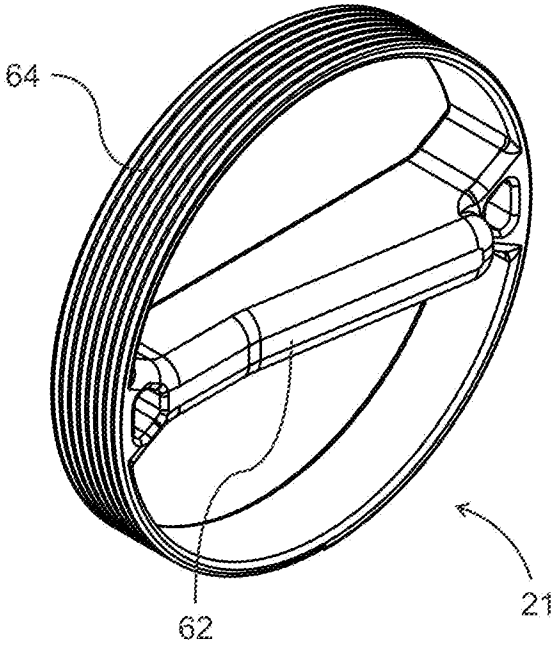
FIG. 5B is an isolated perspective view of the circular handle shown in FIG. 5A in accordance with an embodiment of the present invention.
Figure 5A:
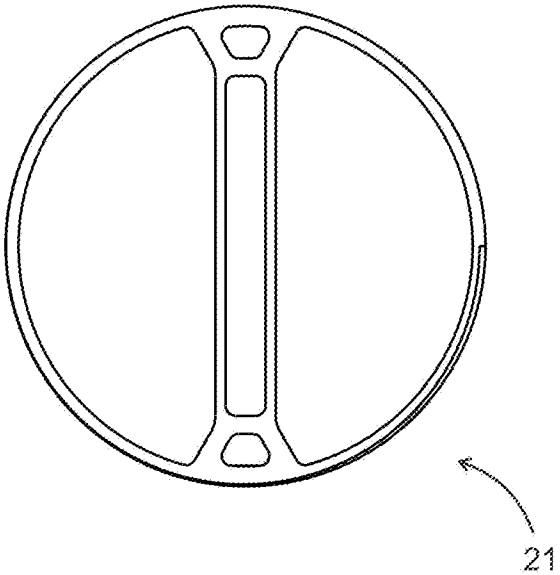
FIG. 5A is an isolated front view of a circular handle of a bow in accordance with an embodiment of the present invention.

Referring now to FIG. 5A and 5B, FIG. 5A is an isolated front view of the circular rotating handle 21 according to an embodiment of the present invention. FIG. 5B is the perspective view of the handle 21. The handle 21 is a circular structure with a handgrip region 62 along its diameter. The handle 21 can be made of any materials that are strong, rigid and light. In a preferred embodiment, the handle 21 is made of the same material as the riser 20, such as magnesium alloy or aluminum and titanium alloys. Machining or molding can be used to manufacture the handle 21. Preferably, the handle 21 should be rigid enough to withstand the tension from the riser 20 in the locking mechanism that will be described in a greater detail below. The outer diameter of the handle 21 should match the inner diameter of the circular frame 22 in the riser so that the handle 21 can be mounted on the circular frame 22 without the chance of coming off. On the outer circumference wall of the handle 21, it contains a series of parallel thread cuts 64. The depth and dimension of the thread cuts 64 should match with those of the thread cuts 23 on the inner wall of the circular frame 22. Thus, when the handle 21 is put in the inner circular space of the circular frame 22, the handle 21 is mounted on riser 20 through the matching of the thread cuts 64 and 23. Since both 64 and 23 are a parallel series of thread cuts, the handle 21 can freely rotate along the inner circumference of the circular frame 22. The handgrip region 62 can be made of the same materials as the rest of the handle 21. It can also be made of other soft materials or rigid material covered by soft materials so that the archers can hold the bow 10 more comfortably.

Figure 6:
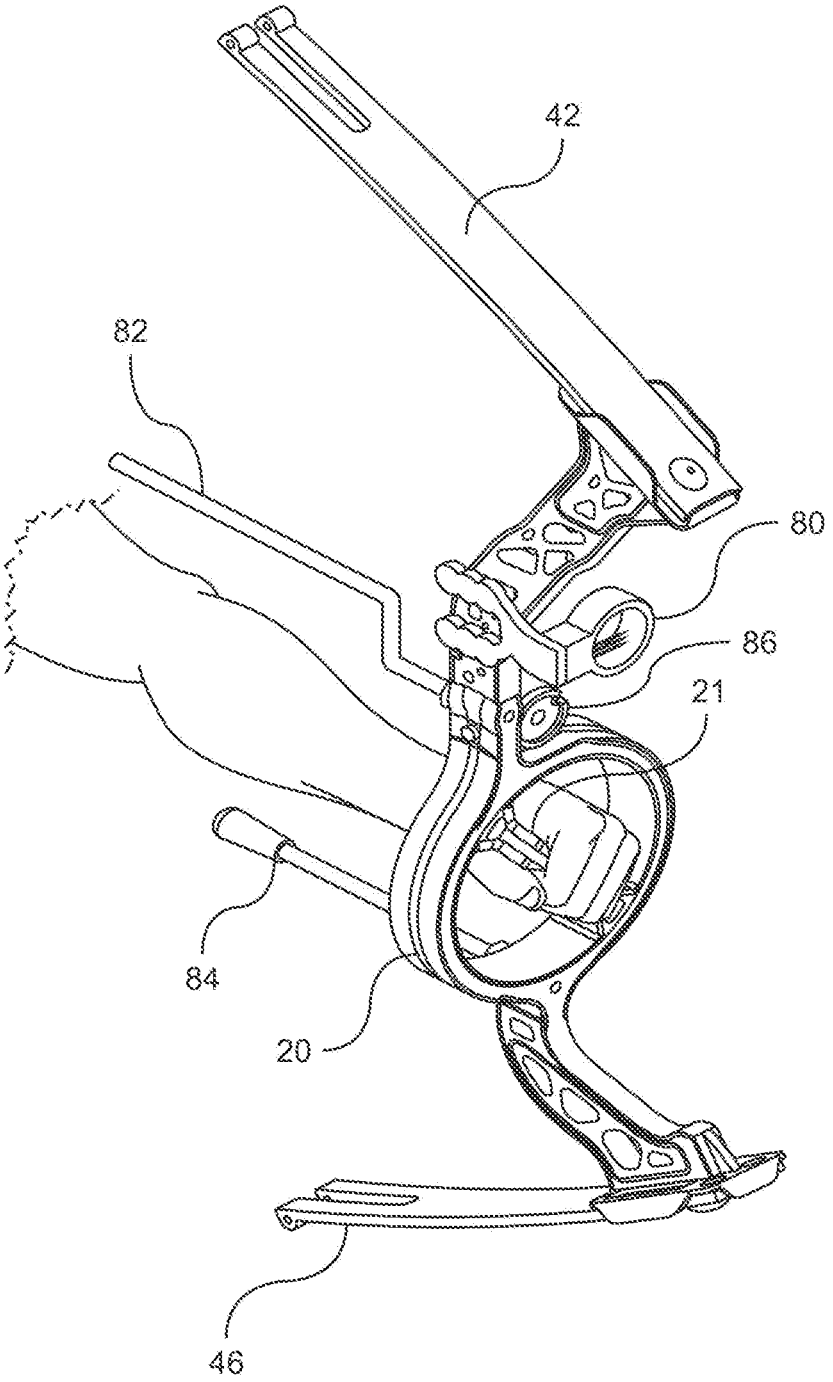
FIG. 6 is a perspective view of a bow held by an archer in accordance with an embodiment of the present invention.

Referring to FIG. 6, archers using the versatile bow 10 can rotate the handle 21 to adjust the orientation of the handgrip region 62. The adjustable rotating handle 21 allows the wrist of the archers to be at various angles to the bow riser 20. The adjustable rotating handle 21 allows archers to hold the bow 10 at their most comfortable and natural wrist position and provides the archers maximum forearm clearance to the strings. The natural wrist position also allows the archers to draw the string 94 with maximum power and to shoot more accurately by reducing the possibility of torqueing. When the archers release the string 94, the archers are less likely to twist the bow because they are gripping the bow at their most comfortable position.

However, if the handle 21 is freely rotatable during string drawing and releasing, the orientation of the handle 21 could change slight at the moment the string 94 is released. This will result in the movement of the bow 10 and torqueing, thus affecting the accuracy of shooting. To address this issue, in preferred embodiments of the present invention, a mechanism is provided to lock the orientation of the handle 21 after the archers have adjusted the orientation of the handle 21 to their most comfortable and natural wrist position. The locking mechanism will be discussed with greater detail below.

Referring now to FIG. 4, it shows an enlarged prospective view of an upper limb pocket 34 in accordance with an embodiment of the present invention. It should be understood that the structure and the components of the lower limb pocket 36 are substantially the same as those of the upper limb pocket 34. The upper limb pocket 34 comprises two sidewalls 304 and 306 and a bottom wall 302 to form an enclosed area for the upper limb 42 to be inserted. An aperture 310 is located in the middle of the upper limb pocket 34 near the bottom wall 302. Referring to FIG. 1A, when the upper limb 42 is inserted into the limb pocket 34, the upper limb 42 is secured by limb bolt 404. The limb bolt 404 is screwed from the top surface of the upper limb 42 and penetrates through the aperture 310 to tighten the upper limb 42. Returning to FIG. 4, in some embodiments of the present invention, two additional apertures 308 are present in the side opposing the bottom wall 302. These apertures 308 provide additional means to secure the upper limb 42 by any type of mounting devices such as screws or rivets to be inserted through the apertures 308.

Figure 7C:
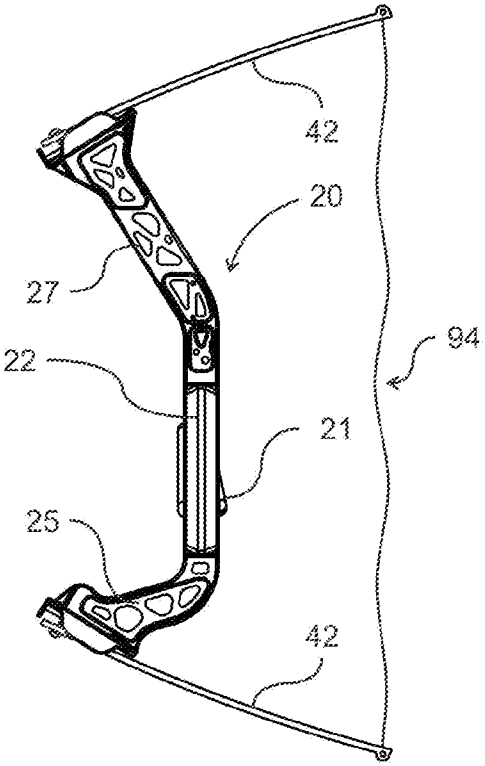
FIG. 7C is a side view of a riser of a bow with two limbs and a string loosened in accordance with an embodiment of the present invention.
Figure 7B:
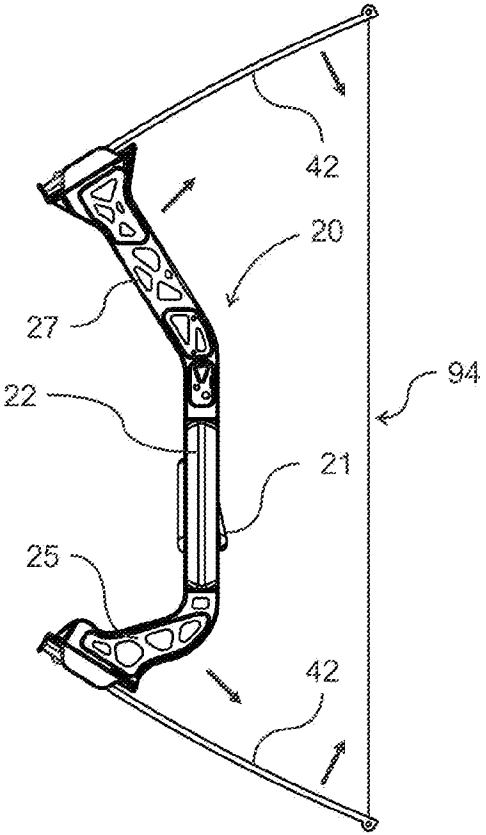
FIG. 7B is a side view of a riser of a bow with two limbs and a string tightened in accordance with an embodiment of the present invention.
Figure 7A:
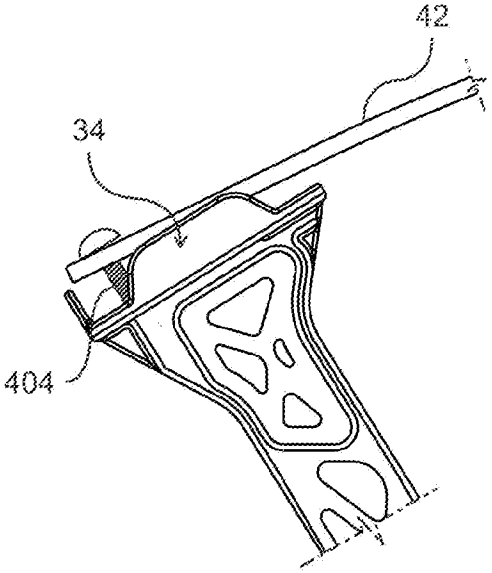
FIG. 7A is an enlarged side view of an upper limb pocket of a riser showing a limb bolt in accordance with an embodiment of the present invention.

FIG. 7A shows how the limb bolt 404 secures the limb 42 or 46 in the limb pocket 34 or 36. When the limb bolt 404 is screwed all the way in, the limb 42 or 46 will be completely tightened in the limb pocket 34 or 36. When the limb bolt 404 is loosened, the limb 42 or 46 will still be attached to the riser 20. Yet, the limb 42 or 46 will not be entirely secured or tightened. Unscrewing the limb bolt 404 entirely allows the archers to replace the limb 42 or 46.

FIG. 7A, 7B, and 7C illustrate a convenient mechanism to lock the orientation of the handle 21 in some preferred embodiments of the present invention. This mechanism allows archers to lock the handle 21 without using or installing any additional structural component. FIG. 7B shows the side view of the riser 20 when the limb bolts 404 in FIG. 7A is screwed all the way into the aperture 310. The limbs 42 and 46 are completely tightened and the string 94 is stretched. This creates tension on the string 94 that pulls the limbs 42 and 46 towards each other. Referring now to the geometry of the riser 20 in this side view FIG. 7B, the riser 20 has a special shape in which the upper arm 27 and the lower arm 25 of the riser 20 elevate away from the location of the circular frame 22. Thus, the circular frame 22 is located closer to the string 94. When the limbs 42 and 46 and the string 94 are tightened, the string 94 pulls the limbs 42 and 46 towards each other. This tension also pulls the upper arm 27 and the lower arm 25 of the riser 20 slightly backward toward the location of the circular frame 22. This creates internal tension in the riser 20. As the circular frame 22 is located in between the upper arm 27 and the lower arm 25, the tension in the riser 20 that pulls the upper arm 27 and the lower arm 25 towards the location of the circular frame 22 slightly distorts the shape of the circular frame 22. The change in shape of the circular frame 22 is usually hardly noticeable by the naked eye because distortion is slight. But since the dimension and size of the thread cuts 23 and 64 on the outer wall of the handle 21 and on the inner wall of the circular frame 22 match, the interaction between these thread cuts are highly sensitive to slight change in the shape of the circular frame 22. As a result of the distortion, the thread cuts 23 and 64 can no longer move along each other smoothly. Thus, the slight distortion of the circular frame 22 is sufficient to prevent the handle 21 from moving. Therefore, when the limb bolts 404 are tightened, the orientation of the handle 21 is locked even though the limb bolts 404 and the handle 21 are not directly connected or even interacted with each other. Preferably, the riser 20 is made of metal alloys and is skeletonized to slightly increase the degree of distortion of the circular frame 22 so that the handle 21 is locked more tightly. The unique geometry and arrangement of the riser 20 provides a convenient locking mechanism to the handle 21 without any additional component.

FIG. 7C shows the side view of the riser 20 when the limb bolt 404 in FIG. 7A is loosened. Although the limbs 42 and 46 and the string 94 are still attached, these components are loosened and no tension exists in any component of the bow 10. Thus, no tension is created in the riser 20 and the circular frame 22 is restored to its original shape. Now the thread cuts 23 and 64 can move along each other. In this arrangement, the handle 21 can freely rotate planarly in the circular frame 22. The archers can rotate and adjust the orientation of the handle 21 to their preferred position before shooting. The archers can then lock the handle 21 by tightening the limb bolts 404. This type of locking mechanism is preferable for most archers because archers commonly loosen the limb bolts and limbs for better storage. They usually only tightened the limb bolts before the shooting. Therefore, the adjustment of the handle 21 can be carried out before shooting and the locking of the handle 21 can be achieved with any additional steps other than tightening the limb bolts 404 required.

Other locking mechanisms may also be used for the embodiments of the present invention. For example, a stopper, such as a clip, a clasp, or a brace, can be installed at one point of the circumference of the circular frame 22 to connect the circular frame 22 and the handle 21 to hold the handle 21 in position.

The invention has been described in terms of preferred embodiments thereof, but is more broadly applicable as will be understood by those skilled in the art. The scope of the invention is only limited by the scope of the following claims and equivalents thereof.

We claim:

1. A bow for shooting an arrow, the arrow having a line of travel in a forward direction, said bow comprising:

a circular frame substantially perpendicular to the line of travel;

a handle rotatably mounted within said circular frame;

a first arm connected to the circular frame;

a second arm connected to the circular frame;

a string connected to said first and second arms, wherein said string when pulled causes said first and second arms to flex sufficiently to cause said circular frame to become distorted to prevent rotation of said handle; and, whereby said rotating handle is locked and unlocked by the distortion to the circular frame caused by the amount of tension applied to said string.

2. The bow of claim 1, wherein the handle has a first plurality of parallel circular thread cuts and the circular frame has a second plurality of circular parallel thread cuts, the handle being mounted within the circular frame by matching the first plurality of thread cuts to the second plurality of thread cuts, such that the handle can freely rotate without coming off the circular frame.

3. The bow of in claim 1, wherein said first arm extends in the forward direction, with a first limb pocket connected to the first arm at an end opposite to the circular frame; and said second arm extends in the forward direction, with a second limb pocket connected to the second arm at an end opposite to the circular frame.

4. The bow of claim 1 further comprising a means for locking the handle in position.

5. The bow of claim 3, further comprising:

a pair of limbs secured to the first limb pocket and the second limb pocket respectively through a pair of mounting devices, the limbs extending in a rearward direction.

6. The bow in claim 5, wherein the mounting device is a limb bolt that can be adjusted to vary the amount of tension required to lock the handle in place.

7. The bow in claim 6, wherein both the first arm and the second arm extend away from the circular frame such that the string is located closer to the circular frame than to the first limb pocket and the second limb pocket.

8. The bow in claim 7, wherein the handle can be locked in position by tightening the mounting devices and rotated by loosening the mounting devices;

wherein when the mounting devices are tightened, the string creates tension that pulls the pair of limbs towards each other, and the pair of limbs correspondingly pull the first arm and the second arm towards the circular frame, thereby distorting the shape of the circular frame and locking the handle in position.

9. A method of locking the handle in position of the bow in claim 8, the method comprising:

rotating the handle to a position;

tightening the mounting devices and the string so that the string creates tension that pulls the pair of limbs towards each other, distorting the shape of the circular frame to lock the handle in position.

10. A bow for shooting an arrow, the arrow having a line of travel in a forward direction, said bow comprising:

a circular frame substantially perpendicular to the line of travel;

a handle rotatably mounted within said circular frame;

a first arm connected to the circular frame;

a second arm connected to the circular frame;

an first limb connected to said first arm by a first limb bolt;

a second limb connected to said second arm by a second limb bolt;

a string connected to said first limb and said second limb, wherein said string when pulled causes said first and second arms to flex sufficiently to cause said circular frame to become distorted to prevent rotation of said handle;

said first and second limb bolts are adjustable to vary the distance said string must be pulled before rotation of said handled is prevented; and, whereby said rotating handle is locked and unlocked by the amount of tension applied to said string.

* * * * *